US005805954A

United States Patent [19]

Takahashi

[11] Patent Number: 5,805,954

[45] Date of Patent: Sep. 8, 1998

[54] IMAGE FORMING APPARATUS THAT DETECTS ENVIRONMENTAL CONDITIONS

[75] Inventor: Sadao Takahashi, Tokyo, Japan

[73] Assignee: Ricoh Company, Ltd., Tokyo, Japan

[21] Appl. No.: 625,529

[22] Filed: Mar. 29, 1996

[30] Foreign Application Priority Data

Mar. 30, 1995 [JP] Japan ..... 7-074282
Mar. 21, 1996 [JP] Japan ..... 8-064580

[51] Int. Cl.[6] ..... G03G 15/00; G03G 15/02

[52] U.S. Cl. ..... 399/44; 399/50

[58] Field of Search ..... 399/44, 50, 94, 399/97, 174, 176; 361/220, 221, 225

[56] References Cited

U.S. PATENT DOCUMENTS

| | | | |
|---|---|---|---|
| 5,479,243 | 12/1995 | Kurokawa et al. | 399/176 X |
| 5,585,896 | 12/1996 | Yamazaki et al. | 399/174 |
| 5,606,399 | 2/1997 | Kikui | 399/44 X |
| 5,649,265 | 7/1997 | Tabuchi | 399/44 |

FOREIGN PATENT DOCUMENTS

| | | |
|---|---|---|
| 42 40 549 | 6/1993 | Germany . |
| 3-94282 | 4/1991 | Japan . |
| 4-186381 | 7/1992 | Japan . |
| 5-80637 | 4/1993 | Japan . |

OTHER PUBLICATIONS

Patent Abstracts of Japan, vol. 17, No. 600, (P–1637), Nov. 4, 1993, JP–05–181350, Jul. 23, 1993.

Patent Abstracts of Japan, vol. 16, No. 511, (P–1441), Oct. 21, 1992, JP–04–186381, Jul. 3, 1992.

Patent Abstracts of Japan, vol. 13, No. 436, (P–938), Sep. 29, 1989, JP–01–164972, Jun. 29, 1989.

*Primary Examiner*—William J. Royer
*Attorney, Agent, or Firm*—Oblon, Spivak, McClelland, Maier & Neustadt, P.C.

[57] ABSTRACT

An image forming apparatus is provided which includes a charging roller (2) for charging an image carrying medium (1) by coming in contact with the image carrying medium (1), a power source (21) for applying a reference voltage to the charging roller (2), a potential sensor (10) for detecting a charged voltage of the image carrying medium (1), a temperature sensor (11) for detecting environmental conditions of the charging roller (2), and a CPU (20) for controlling the power source (21) from a detection result obtained by the potential sensor (10) and a detection result obtained by the temperature sensor (11). The CPU (20) makes alterations to the reference voltage of the power source (21) so that the charge potential of the image carrying medium (1) can be brought to a target potential level, and sets an execution timing for the alterations.

10 Claims, 8 Drawing Sheets

| DETECTED TEMPERATURE | REFERENCE VOLTAGE |
|---|---|
| 10°C | - 2200 V |
| 15°C | - 1900 V |
| 20°C | - 1700 V |
| 25°C | - 1650 V |
| 30°C | - 1620 V |
| 40°C | - 1600 V |

IMAGE FORMING APPARATUS THAT DETECTS ENVIRONMENTAL CONDITIONS

BACKGROUND OF THE INVENTION

1. Field of the Invention

This invention relates to an improvement of an electrophotographic type image forming apparatus in which an electric charge is supplied to an image carrier, such as a photosensitive member, by bringing a charger means, such as a charging roller, into contact with the image carrier.

2. Discussion of the Background

Heretofore, there are known an electrostatic copying machine, a printer and the like as image forming apparatus. An image forming apparatus of this type includes a charger-device for supplying an electric charge to a photosensitive body as an image carrier. A corona type discharge device is widely used as the charger-device. In this corona discharge type charger-device, in order to supply a charge potential of, for example, 500 volts to 800 volts to the photosensitive member, it is required to supply such a high voltage as ranging from 4 kilo-volts to 8 kilo-volts to the charger-device itself. For this reason, corona products, such as ozone and the like, are produced by corona discharge. The corona products tend to deteriorate the various component parts of the image forming apparatus and the photosensitive member. To prevent this, the image forming apparatus, which is equipped with the corona discharge type charger-device, is provided with an ozone decomposition filter and an air-stream generating fan in order to remove such corona products. However, the employment of the ozone decomposition filter and the air-stream generating fan makes the construction of the apparatus more complicated to that extent.

In view of the above, recently, such attention has been paid to an image forming apparatus of the type in which a charging roller is employed as a contact-to-charge means for contacting and charging an image carrier. This contact-to-charge type image forming apparatus offers a lot of advantages. For example, a voltage to be applied to the charging roller can be lowered when a photosensitive member is charged; the quantity of ozone produced during the course of applying an electric charge to the image carrier can be minimized, the provision of the ozone filter and the air-stream generating fan is not required any more; and so on.

However, in the image forming apparatus which employs the contact-to-charge means, the charge potential to be applied to the photosensitive member is subjected to adverse effects of a value of resistance of the charging roller, and therefore the charge potential to be applied to the photosensitive member varies depending on the value of resistance of the charging roller. The ratio of variation of the charge potential to the photosensitive member becomes greater as the linear velocity of the surface of the photosensitive member is increased.

FIG. 1 illustrates a relation between the value of resistance of the charging roller and the charge potential on the surface of the photosensitive member, serving the linear velocity of the surface of the photosensitive member as a parameter. In FIG. 1, the value of resistance of the charging roller is plotted along the abscissa, and the charge potential on the surface of the photosensitive member is plotted along the ordinate. In the example shown in FIG. 1, a reference voltage to be applied to the charging roller is −1600 volts and there is shown a variation of the charge potential with respect to the value of resistance of the charging roller when the linear velocity of the surface of the photosensitive member varies as 60 mm/sec, 200 mm/sec and 400 mm/sec. The value of resistance of the charging roller is variable depending on the surrounding environment, particularly on the changes of temperature and moisture. FIG. 2 illustrates a relation between the temperature and the value of resistance of the charging roller, serving the moisture as a parameter. In FIG. 2, the temperature is plotted along the abscissa, and the value of a resistance of the charging roller is plotted along the ordinate. In the example shown in FIG. 2, there is shown a variation of the value of resistance with respect to the temperature when the moisture percentages are 15% and 90%.

In this way, the value of resistance of the charging roller varies depending on the surrounding environment and therefore it is difficult to maintain a constant charge potential on the surface of the photosensitive member.

In view of the above, in order to keep the charge potential of the photosensitive member at a target potential (for example, −900 volts) level irrespective of variation of the environment, the conditions of the surrounding environment are detected and a value of resistance of the charging roller is anticipated based on this detected result so that the reference voltage to be applied to the charging roller is corrected. However, the charge potential of the photosensitive member is not always set to the target potential level due to irregularity of values of resistance of the individual charging rollers and under the effect of aging change (i.e., change suffered with the lapse of time) of the charging rollers.

On the other hand, also in the corona discharge type charger-device, the charge potential of the photosensitive member is varied due to change of the surrounding environment and under the effect of aging change of the charger-device, etc. For this reason, heretofore, in the corona discharge type charger-device, the charge potential on the surface of the photosensitive member is measured and the reference voltage to be applied to the charger-device is corrected such that the charge potential on the surface of the photosensitive member can be kept at the target potential level. This type of correction is frequently accompanied by interruption of the image forming procedures.

In the corona discharge type charger-device, the environmental conditions, which can be a cause of variation of the charge potential on the photosensitive member, is shifted with a gentle level, and therefore the number of times required for the correction can be rather small, for example, once at the time of turning-on of the power source. Only when the correction is made after the passage of a predetermined time, there exists almost no difference is charge potential of the photosensitive member with respect to the target potential level even if the corrected reference voltage is applied to the charger-device until the time when the power source is turned off. Accordingly, in the corona discharge type charger-device, an image of stabilized quality can be obtained without frequently correcting the reference voltage which is to be applied to the charger-device.

Therefore, an idea has been proposed in which the image forming apparatus utilizing the contact-to-charge means employs the method of correcting the reference voltage to be applied to the charging roller so that the charge potential on the surface of the photosensitive member can be kept at the target potential level. However, the employment of this method brings about the following inconveniences.

In some image forming apparatus (which has a large linear velocity on the surface of the photosensitive member), images are continuously formed on 40 to 60 sheets of paper per minute, or 60 sheets or more of paper per minute at a time. In this type of image forming apparatus, the temperature of the charging roller rapidly rises due to heat caused by contact friction with the photosensitive member and due to a rise in temperature within the apparatus (caused mainly by fixation), and the value of resistance of the charging roller varies in a very short time. Accordingly, when the correction is made only once at the time for turning on the power source, or when a correction is made at a long time interval (once in a day, for example), the variation of the charge potential of the photosensitive member becomes too large, and the variation of the image density becomes too large, with the result that the image quality is deteriorated. In order to avoid this variation of the image density, it is required to frequently correct the reference voltage to be applied to the charging roller at extremely short time intervals and, as a result, the image forming procedure is required to be interrupted frequently.

SUMMARY OF THE INVENTION

The present invention was made in view of the above-mentioned situation. It is, therefore, an object of the present invention to provide an image forming apparatus capable of minimizing, as much as possible, the number of times for interrupting an image forming procedure while avoiding deterioration of the image quality even in the case where the image forming apparatus employs a method of correcting a reference voltage to be applied to a contact-to-charge type means in order to keep the surface of a photosensitive member at a target potential level by measuring the charge potential on the surface of the photosensitive member.

In order to achieve the object, an image forming apparatus according to an aspect of the present invention comprises contact-to-charge means for containing the charging an image carrier; voltage applying means for applying a reference voltage to the contact-to-charge means; potential detection means for detecting charged voltage of the image carrier; environmental condition detection means for detecting environmental conditions which have an effect on the charge potential of the contact-to-charge means; and control means for controlling the voltage applying means based on a detected result of the potential detection means and a detected result of the environmental condition detection means. The control means comprises reference voltage correction means for correcting the reference voltage of the reference voltage applying means so that the charge potential of the image carrier is brought to a target potential level, and timing setting means for setting an execution timing of the reference voltage correction means.

Preferably, the environmental condition detection means is a temperature sensor or a moisture sensor. Both the temperature sensor and moisture sensor may be employed.

The timing setting means establishes an execution timing for the reference voltage correction means based on the detected result of the temperature sensor. Preferably, the timing setting means reduces a time interval for correcting the reference voltage when the detected temperature of the contact-to-charge means detected by the temperature sensor is low, and the timing setting means increases a time interval for correcting the reference voltage when the detected temperature of the contact-to-charge means detected by the temperature sensor is high.

The timing setting means may be given a corresponding relation between the temperature of the contact-to-charge means and the number of copy sheets in order to increase the execution time interval of the reference voltage correction means as the temperature of the contact-to-charge means rises.

The timing setting means may execute the correction of the reference voltage when a temperature difference between the preceding temperature previously detected by the temperature sensor and the present temperature successively detected by the temperature sensor is equal to or more than a comparison reference value. In this case, it is preferred that the timing setting means changes the comparison reference value based on the temperature detected by the temperature sensor, so that the number of times of execution of the reference voltage correction means is reduced as the temperature of the contact-to-charge means rises.

The reference voltage correction means may control the reference value of the voltage applying means based on the temperature of the contact-to-charge means so that the charge potential of the carrier may come closer to the target potential level.

DETAILED DESCRIPTION OF THE PREFERRED EMBODIMENTS

Figure 3:
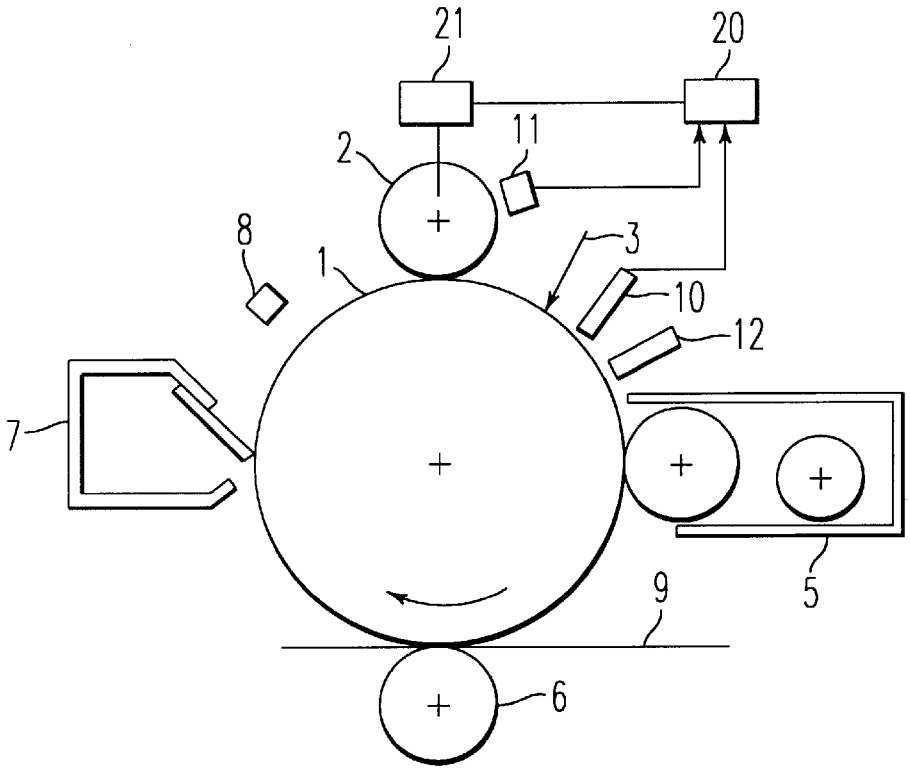
FIG. 3 is a schematic view showing a construction of a main part of an image forming apparatus according to the present invention.

FIG. 3 is a schematic view of a main part of an image forming apparatus according to one embodiment of the present invention. In FIG. 3, reference numeral 1 denotes a photosensitive drum, as an image carrier, having photoconductive properties, and reference numeral 2 denotes a charging roller as a contact-to-charge means. The photosensitive drum 1 can rotate in a direction as indicated by an arrow. The charging roller 2 is brought into contact with the photosensitive drum 1 under a predetermined pressure and is rotated in accordance with the rotation of the photosensitive drum 1. On the periphery of the photosensitive drum 1, there are a potential sensor 10 as a potential detection sensor, an eraser 12, a developer device 5, a transfer roller 6, a cleaning device 7 and a quenching exposure device 8 which are arranged in this order in the direction of rotation of the photosensitive drum 1. A reference voltage (for example, −1600 volts) is applied to the charging roller 2 by a power source 21 as a voltage applying means. In forming an image, the photosensitive drum 1 is quenched by the quenching exposure device 8. During rotation, the photosensitive drum 1 is charged to a minus potential level by the charging roller 2. The photosensitive drum 1 is then exposed to light by an exposure device, not shown, so that an electrostatic latent image is formed on the surface of the photosensitive drum 1. In FIG. 3, an arrow 3 indicates light for exposure. The eraser 12 then removes a charge at a non-image portion of the photosensitive drum 1 with an electrostatic latent image formed thereon. A positive bias charge is supplied to the developer device 5 and toner, which has been supplied from the developer device 5, is attracted to the photosensitive drum 1 during its rotation. By this, the electrostatic latent image becomes a visible image.

A sheet of transfer paper 9 is fed between the photosensitive drum 1 and the transfer roller 6 at a predetermined timing, and the toner image formed on the photosensitive drum 1 is transferred to the transfer paper 9 by the transfer roller 6 which has been supplied with a negative voltage. Thereafter, the transfer paper 9 is fed to a fixing device, not shown. The toner image is fixed to the transfer paper 9 by the fixing device. On the other hand, the remaining toner on the photosensitive drum 1 is removed by the cleaning device 7 after the completion of transfer, and then the photosensitive drum 1 is uniformly quenched by the quenching exposure device 8. By this, a sequence of image forming procedures (for obtaining one copy) is finished. In case an image forming procedure is required to be performed continuously, the photosensitive drum 1 is continuously rotated and the procedures after the charging operation made by the charging roller 2 are continuously executed. The potential sensor 10 is installed at a location away from the surface of the photosensitive drum 1 with the space of 2 mm to 3 mm. The potential sensor 10 is operated to detect the charge potential on the surface of the photosensitive drum 1.

The charging roller 2 is formed by covering a conductive core with an elastic layer composed of an epichlorohydrine rubber. On the surface of the elastic layer, a surface layer having a favorable removability with respect to a developing agent is formed in accordance with necessity. A temperature sensor 11 as an environmental condition detection means is provided in the vicinity of the charging roller 2. The temperature sensor 11 is operated to indirectly detect the temperature of the charging roller 2 by detecting the peripheral temperature of the charging roller 2. In this embodiment of the present invention, the temperature sensor 11 is installed away from the charging roller 2. However, it is also acceptable that the temperature sensor 11 is brought into contact with the charging roller 2 in order to directly detect the temperature of the charging roller 2.

Figure 4:
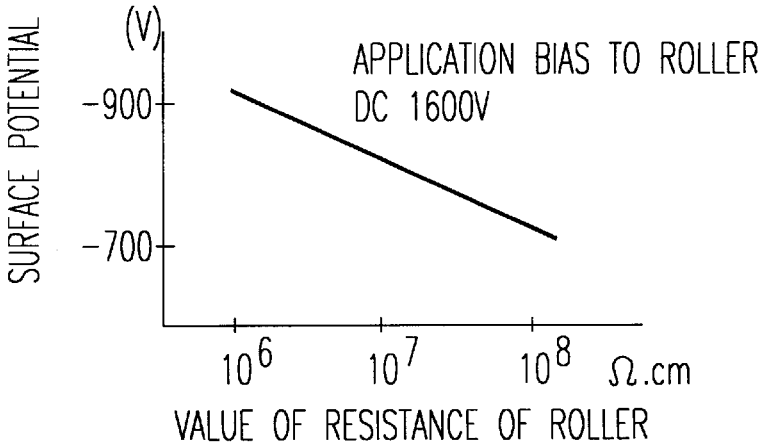
FIG. 4 is a graph showing a relation between the value of resistance of the charging roller and the charge potential of a photosensitive drum.

As mentioned above, the charge characteristic of the charging roller 2 is managed by the electric characteristic of the elastic layer which covers the periphery of the conductive core. The reason is that the electric resistance value of the epichlorohydrine rubber of the elastic layer is varied in accordance with variation of the environmental conditions such as temperature, moisture and the like. A quantity of variation of the value of resistance of the epichlorohydrine rubber is reduced as the temperature is increase. In other words, it becomes larger as the temperature is lowered. There is a substantially linear proportional relation, as shown in FIG. 4, between the value of resistance of the charging roller 2 and the charge potential of the photosensitive drum 1. When a reference voltage of, for example, DC 1600 volts is applied to the charging roller 2 by the power source 21, if the value of resistance of the charging roller 2 varies from $10^6$ ohm*cm to $10^8$ ohm*cm, the charge potential of the photosensitive drum 1 varies from −900 volts to −700 volts. The power source 21 is controlled by the CPU 20 as a control means. An output information from the potential sensor 10 and another output information from the temperature sensor 11 are input into the CPU 20.

A description will now be given of execution timing (timing for executing the means for correcting the reference voltage to be applied to the charging roller 2) for correcting the reference voltage for the image forming apparatus according to the present invention.

Figure 5:
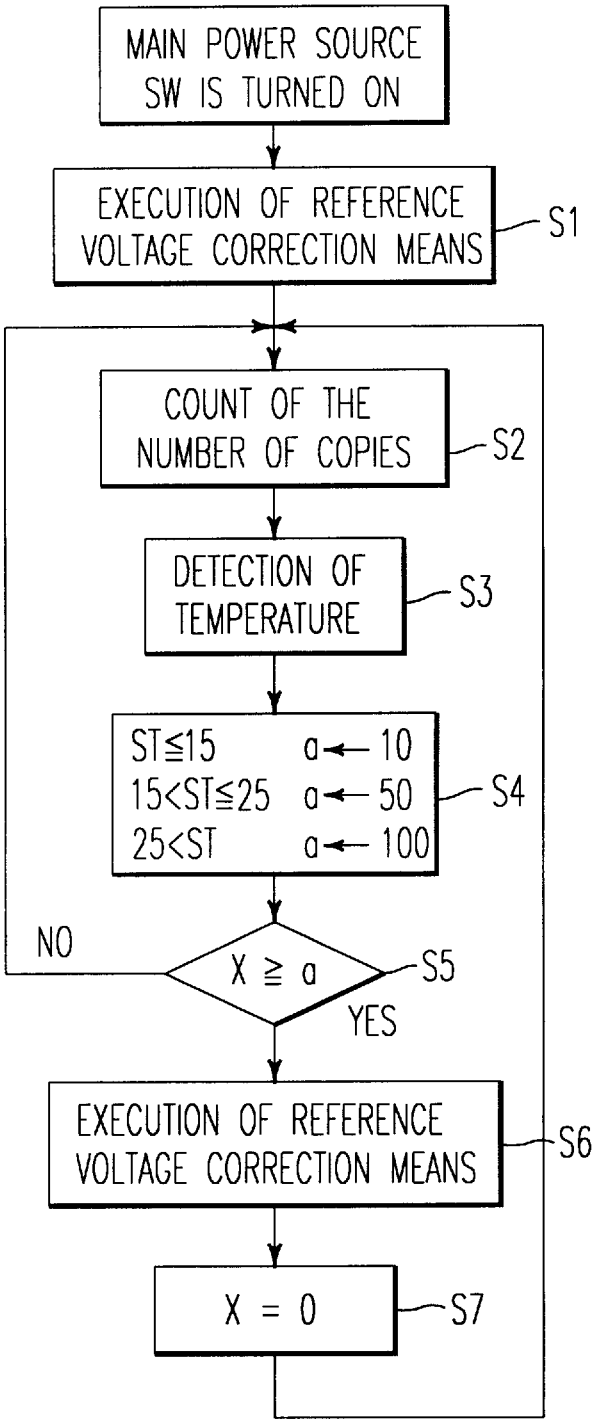
FIG. 5 is a flow chart for explaining a first embodiment of the image forming apparatus according to the present invention, showing the timing for correcting the reference voltage.

FIG. 5 is a flow chart for explaining a first embodiment of an image forming apparatus according to the present invention. The flow chart shows the execution timing of the reference voltage correction means.

When a main power source is turned on, the CPU 20 first executes the reference voltage correction means (S1) as shown in FIG. 5. This reference voltage correction means consists of Step S1 to Step S16 of FIG. 6.

First, the CPU 20 is operated to set the reference voltage of −1600 volts in a memory V1 irrespective of the temperature of the charging roller 2. By this, the voltage of the power source 21 is set to −1600 volts (S10). The photosensitive drum 1 is charged to a predetermined potential level by the reference voltage of −1600 volts applied to the charging roller 2 (S11). Then, the potential sensor 10 detects the charge potential of the photosensitive drum 1 and stores the same in a memory SV (S12). The CPU 20 calculates a difference (V0-SV) between a target potential V0 (here V0=−900 volts) to be applied to the photosensitive drum 1 and a charge potential stored in the memory SV and stores the difference (V0-SV) in a memory Δ (S13). Then, the CPU 20 makes a judgement as to whether or not the difference (V0-SV) is equal to or less than 20 volts which is within an allowable error (S14). If the difference (V0-SV) is not equal to or less than 20 volts, the CPU 20 multiplies the difference (V0-SV) stored in the memory A by k (appropriate correction coefficient k), stores a difference voltage (V1-kA) between the reference voltage stored in the memory V1 and k(V0-SV) (S16), and sets the difference voltage (V1-kA) stored in the memory V2 in the memory V1 as the reference voltage (S16). By this, the voltage of the power source 21 is changed to a newly established reference voltage, and the photosensitive drum 1 is charged to a predetermined potential by the changed reference voltage. By repeating the procedures of Step S1 to Step S16, the charge potential of the photosensitive drum 1 is converged to the target potential level V0. Here, if the charge potential of the photosensitive drum 1 reaches the target potential level V0 within the range of the allowable error, the CPU 20 finishes the reference voltage correction control procedure and the process proceeds to the next Step S2.

In the procedures of Step S2 and thereafter, the CPU 20 sets the execution timing for correction of the reference voltage. The reason is as follows.

Figure 1:
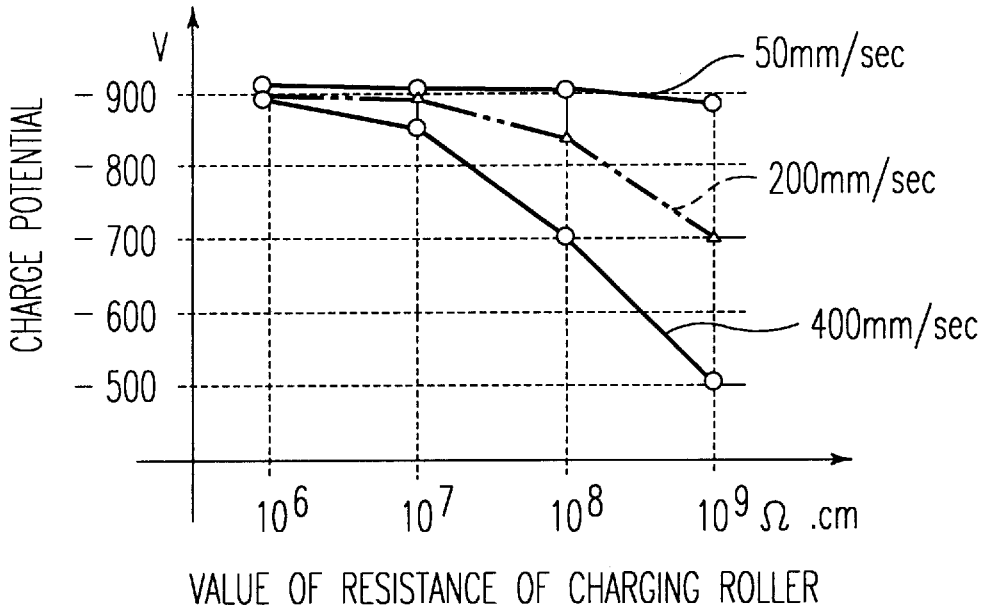
FIG. 1 is a graph showing a relation between the value of resistance of a charging roller and a charge potential on the surface of a photosensitive member, serving a linear velocity of the surface of the photosensitive member as a parameter.
Figure 2:
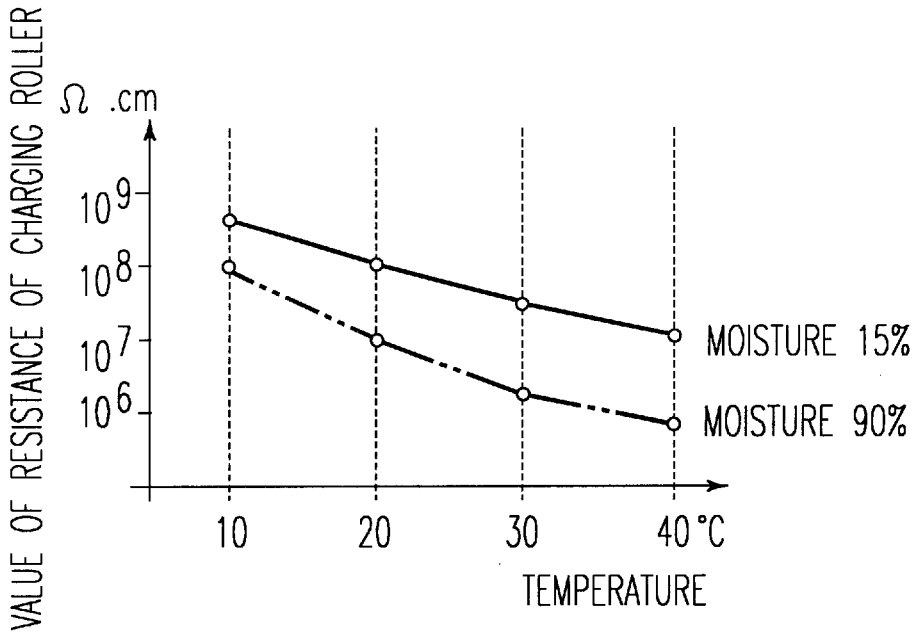
FIG. 2 is a graph showing a relation between the temperature and the value of resistance of the charging roller.

When the procedures for forming an image are repeated dozens of times (more than several tens of times), the temperature of the charging roller 2 is raised by some causes, such as contact friction heat generated between the photosensitive drum 1 and the charging roller 2. When the temperature of the charging roller 2 is raised, the value of resistance of the charging roller 2 is lowered as shown in FIG. 2. When the reference voltage established under the condition of temperature before the temperature is raised is applied to the charging roller 2, the charge potential of the photosensitive drum 1 comes to be larger than the target potential V0. In contrast, when the temperature of the charging roller 2 is lowered, the value of resistance is increased. When the reference voltage established under the condition of temperature before the temperature is lowered is applied to the charging roller 2, the charge potential of the photosensitive drum 1 comes to be smaller than the target potential V0. That is, the reference voltage to be applied to the charging roller 2 must be corrected depending on variation of the temperature of the charging roller 2. The image forming procedure is interrupted at the time for executing the correction of this reference potential. From a view point of reducing the number of times for interrupting the image forming procedure, the frequency of this correction is preferably as small as possible. Also from a viewpoint of the life of the photosensitive drum 1, the number of times of this correction is preferably as small as possible.

When the temperature of the charging roller 2 is high, the variation of the value of resistance of the charging roller is small as apparent from FIG. 2. Accordingly, the quantity of correction of the reference voltage to be applied to the charging roller 2 may be small. In other words, the target potential V0 can be obtained almost without making any correction of the reference voltage. Accordingly, if the time interval for executing the correction is increased as the temperature is raise, the number of times for interrupting the image forming procedure can be reduced.

To be more specific, for example, when the temperature of the charging roller 2 is 15 degrees or less in centigrade, the correction is executed on every ten-copy basis; when the temperature of the charging roller 2 exceeds 15 degrees in centigrade and is raised equal to or less than 25 degrees in centigrade, the correction is executed on every fifty-copy basis; and when the temperature of the charging roller 2 exceeds 25 degrees in centigrade, the correction is executed on every hundred-basis. Owing to this arrangement, the frequency of executing the correction can be reduced while substantially keeping the charge potential of the photosensitive drum 1 at the target potential level V0. Thus, the number of times for interrupting the image forming procedure can be reduced and deterioration of the photosensitive drum 1 can be prevented.

FIG. 5 shows a flow as a means for establishing the timing for executing the correction of the reference voltage based on the number of copies. In Step S2, the CPU 20 sets the content of a count memory X at '+1' every time the image forming procedure is executed once. Then, the CPU 20 reads the temperature read by the temperature sensor 11 in a memory ST (S2). Thereafter, the CPU 20 sets ten (10) copies as the proportional reference value in a memory a when the temperature detected by the temperature sensor 11 is 15 degrees or less in centigrade, sets 50 copies as the proportional reference value in the memory a when the detected temperature is in the range of more than 15 degrees in centigrade but equal to or less than 25 degrees in centigrade, and sets 100 copies as the proportional reference value in the memory a when the detected temperature exceeds 25 degrees in centigrade (S4). Then, the CPU 20 makes a judgment as to whether or not the number of copies stored in the count memory X exceeds the proportional reference value (S5), executes the image forming procedures when the number of copies stored in the count memory X is less than the proportional reference value, and executes the reference voltage correction means by stopping the image forming procedures when the number of copies stored in the count memory X is equal to or more than the proportional reference value stored in the memory a (S6). Then, the CPU 20 sets the content of the count memory X at '0', and the process returns to Step S2.

According to the first embodiment of the present invention, the correction of the reference voltage is executed by setting up a relation between the temperature and the number of copies. Accordingly, the number of times for executing the reference voltage correction means can be lessened almost without accompanying the deterioration of the image quality.

Figure 7:
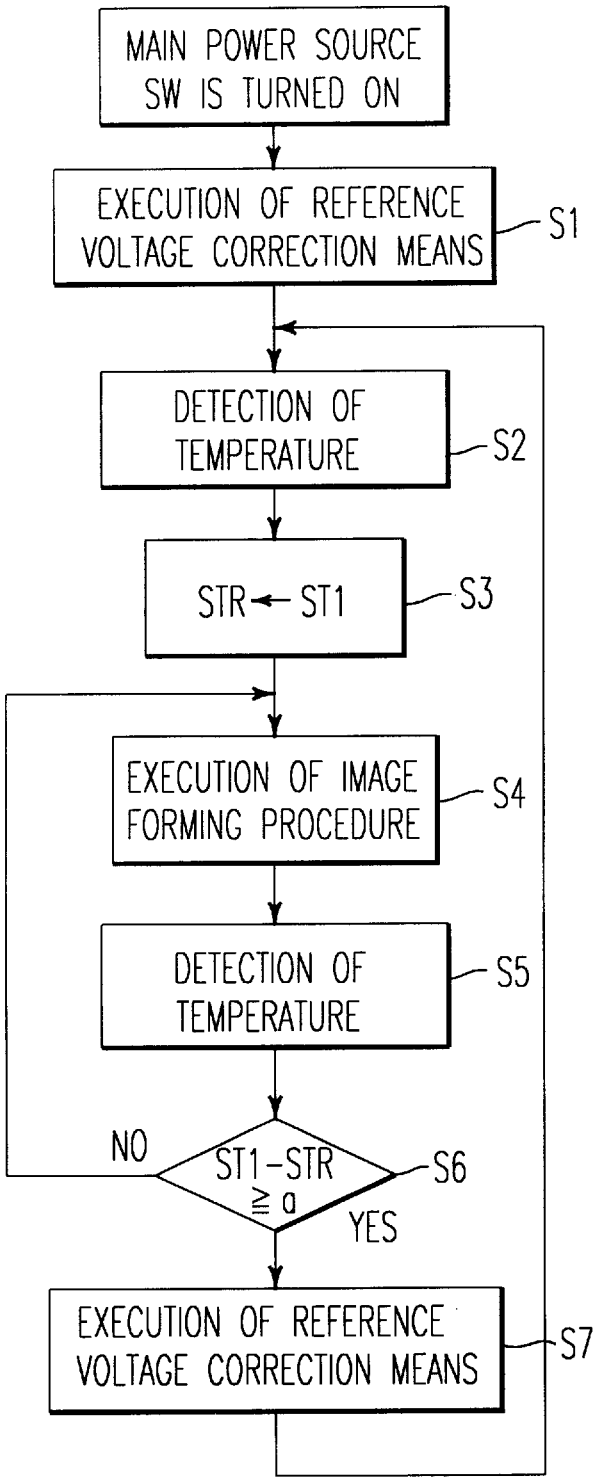
FIG. 7 is a flow chart for explaining a second embodiment of an image forming apparatus according to the present invention, showing the timing for correcting the reference voltage.

FIG. 7 is a flow chart for explaining a second embodiment of the image forming apparatus according to the present invention and is a flow showing the timing for executing the reference voltage correction means.

Figure 6:
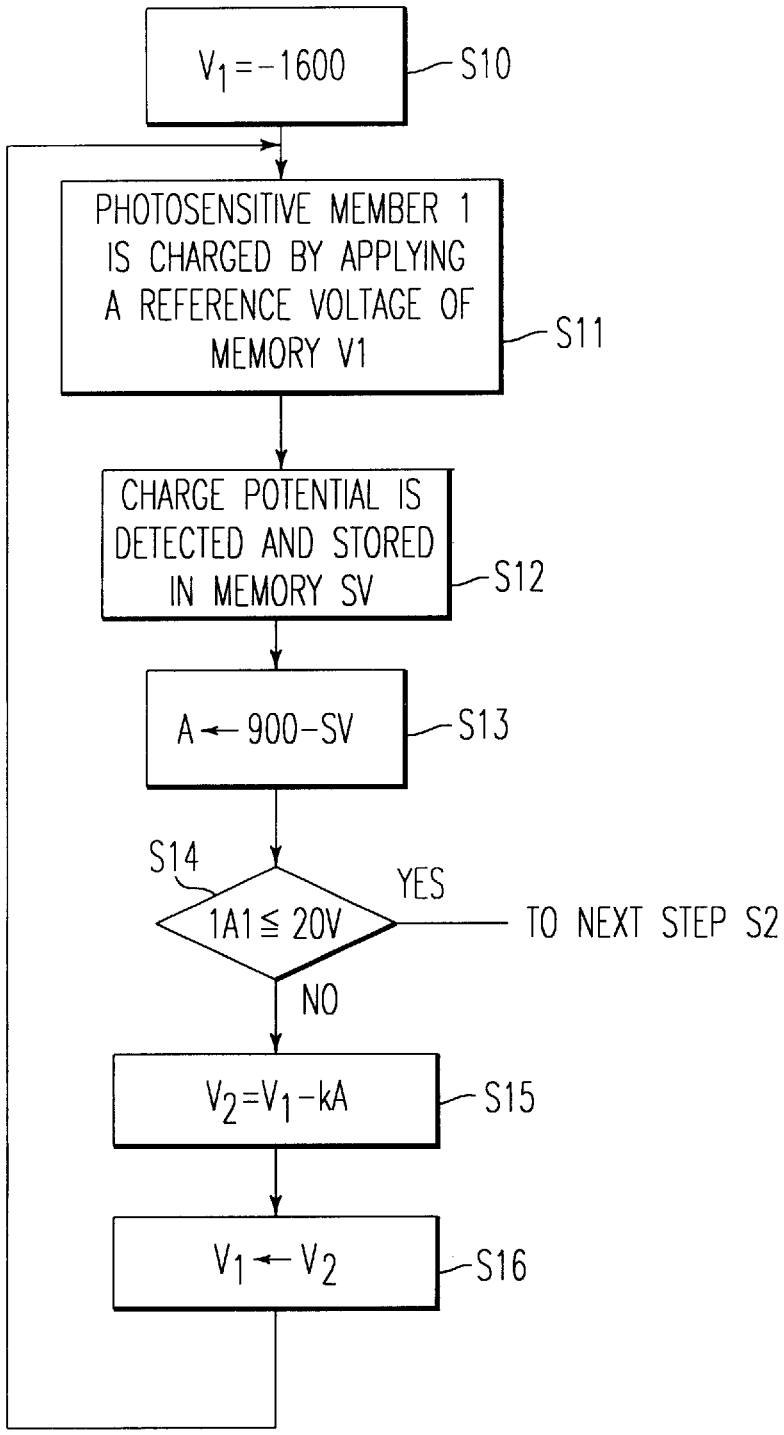
FIG. 6 is a flow chart showing one example of a reference voltage correction means of the image forming apparatus according to the present invention.
Figure 8:
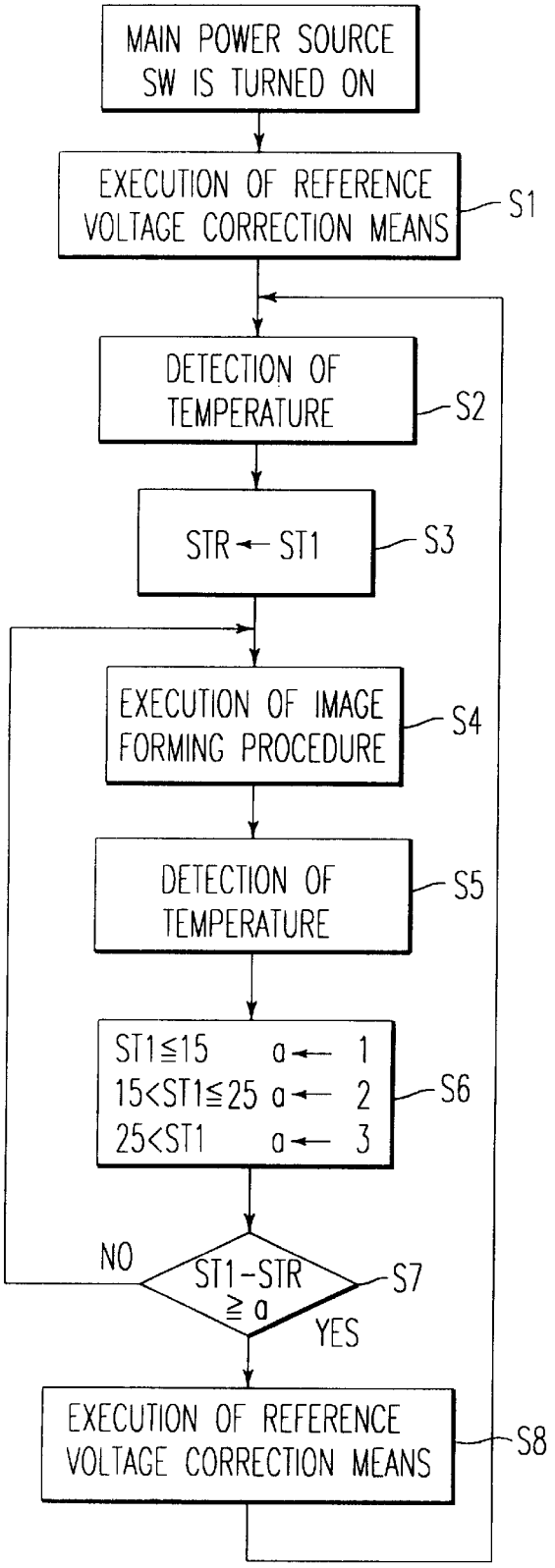
FIG. 8 is a flow chart for explaining a third embodiment of an image forming apparatus according to the present invention, showing the timing for correcting the reference voltage.

When the main power source SW is turned on (S1), the CPU 20 executed the reference voltage correction means of FIG. 6 first. By this, the photosensitive drum 1 establishes the target potential V0. Then, the CPU 20 reads the temperature of the charging roller 2 detected by the temperature sensor 11 and stores the same in a memory ST1 (S2). The temperature stored in the memory ST1 is transferred to a memory STR (S3). The memory ST1 has the role for temporarily storing the temperature data read this time, whereas the memory STR has the role for temporarily storing the temperature data read last time. Then, the CPU 20 executes the image forming procedure once (S4), reads the temperature of the charging roller 2 detected by the temperature sensor 11 and stores the same in the memory ST1 (S5). A temperature difference Δt as the proportional reference value is stored in the memory a. The CPU 20 makes a judgment as to whether or not the difference between the temperature stored in the memory STR read last time and the temperature stored in the memory ST1 read this time is larger than the temperature difference Δt (S6). When the difference is smaller than the temperature difference Δt, the process proceeds to Step S4 where the image forming procedure is executed. In contrast, when the difference is equal to temperature difference Δt or more, the process proceeds to Step S7 where the reference voltage correction means shown in FIG. 6 is executed. Then, the process proceeds to Step S2, FIG. 8 is a flow chart for explaining a third embodiment according to the present invention and shows a flow of the timing for executing the reference voltage correction means. Reference characters (S1) to (S5) correspond to references characters (S1) to (S5), respectively, in FIG. 7, and reference characters (S7) and (S8) correspond to reference characters (S6) and (S7), respectively, in FIG. 7.

The variation of the value of resistance of the charging roller 2 is reduced as the temperature is increased as mentioned above. Therefore, the proportional reference value Δt may be established larger as the temperature of the charging roller 2 is increased.

In the third embodiment of the present invention, the temperature difference is established to be larger as the temperature of the charging roller 2 is increased. For example, '1' is stored as the temperature difference Δt in the memory a when the temperature of the charging roller 2 read this time and stored in the memory ST1 is equal to 15 degrees or less in centigrade, '2' is stored as the temperature difference Δt in the memory a when the temperature of the charging roller 2 read this time and stored in the memory ST1 is more than 15 degrees in centigrade but equal to or less than 25 degrees in centigrade, and '3' is stored as the temperature difference Δt in the memory a when the temperature of the charging roller 2 read this time and stored in the memory ST1 is more than 25 degrees in centigrade (S6).

According to the third embodiment of the present invention, the number of times for executing the reference voltage correction means can be reduced, when compared with the case described with reference to the second embodiment of the present invention, as the temperature of the charging roller 2 is raise.

Figure 9:
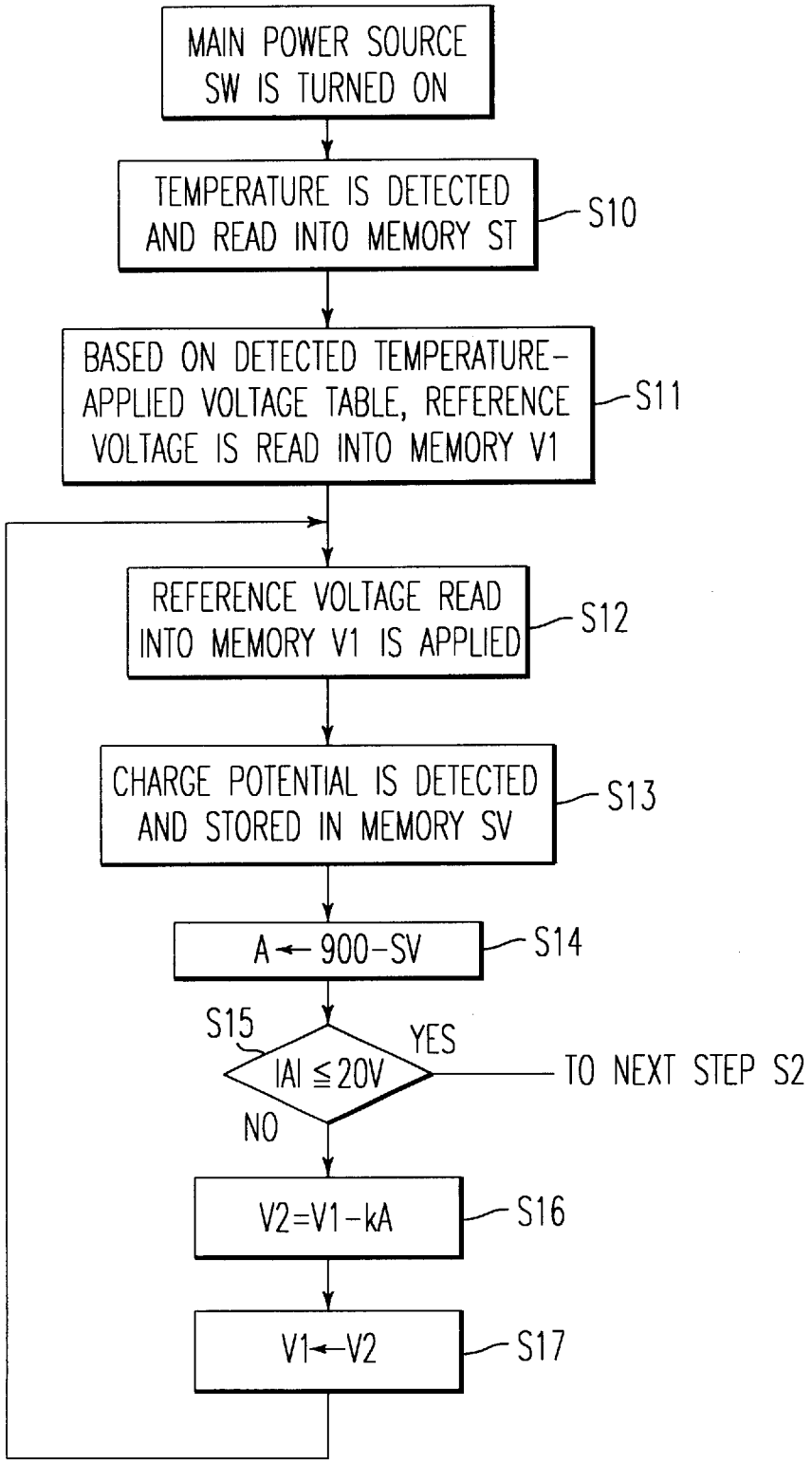
FIG. 9 is a flow chart for explaining another example of a reference voltage correction control of the image forming apparatus according to the present invention and is a flow chart for explaining the reference voltage correction means.
Figures 10, 11:
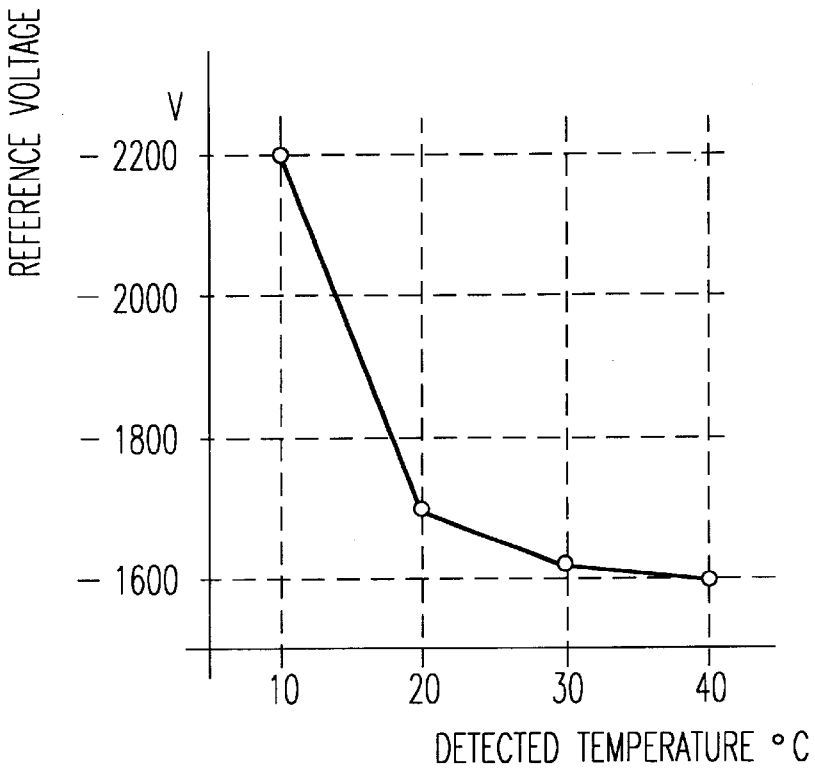
FIG. 10 is a graph showing a relation between the detected temperature of a temperature sensor and the reference voltage according to the present invention.
FIG. 11 is a table showing a relation between the detected temperature of the temperature sensor and the reference voltage according to the present invention.

FIGS. 9 through 11 are view for explaining other examples of a reference voltage correction means of an image forming apparatus according to the present invention. FIG. 9 is a flow chart for explaining the reference voltage correction means.

If a reference voltage obtained based on a value of resistance of the charging roller 2 anticipated from the temperature of the charging roller 2 detected by the temperature sensor 11 is applied to the charging roller 2, a charge potential close to the target potential V0 can be supplied to the photosensitive drum 1 from the beginning. According, the execution time for executing the reference voltage correction means can be reduced.

FIG. 10 is a graph showing a relation between the reference voltage to be applied to the charging roller 2 and the detected temperature of the charging roller 2. Relations between detected temperatures of the charging roller 2 and reference temperatures obtained, as shown in FIG. 11, based on the graph of FIG. 10 are stored in a table memory of the CPU 20. When the main power source SW is turned on, the CPU 20 is operated to read the temperature of the charging roller 2 detected by the temperature sensor 11 in the memory ST (S10) first. Then, the CPU 20 reads a reference voltage corresponding to the detected temperature into the memory V1 based on the detected temperature (S11), and applies the reference voltage read into the memory V1 to the charging roller 2 (S12). Thereafter, the CPU 20 reads the charge potential of the photosensitive drum 1 detected by the potential sensor 10 (S13), calculates a difference (V0-SV) between the target potential V0 and the charge potential stored in the memory SV, and stores this difference (V0-SV) in the memory A (S14). Then the CPU 20 makes a judgment as to whether or not the difference (V0-SV) stored in the memory A is equal to the allowable range 20 volts or less (S15). If the difference (V0-SV) exceeds the allowable range 20 volts, the difference (V0-SV) is multiplied by the correction coefficient k, this k(V0-SV) is subtracted from the reference voltage stored in the memory V1, and the answer value obtained by this subtraction is stored in the memory V2 (S16). Then, the CPU 20 sets the value stored in the memory V2 in the memory V1 (S17), applies the corrected reference voltage stored in the memory V1 to the charging roller 2 (S12), and reads again the detected charge potential (S13). By repeating the sequence of procedures of the above Steps, the charge potential of the photosensitive drum 1 can rapidly be established to the target potential V0.

Also, a moisture sensor may be provided instead of the temperature sensor 11. Alternatively, both the temperature sensor 11 and the moisture sensor may be provided.

Since the image forming apparatus of the present invention is constructed in the manner as hereinbefore described, the number of times for interrupting the image forming procedure can be reduced as much as possible while avoiding the deterioration of the image quality even in the case where the image forming apparatus equipped with the contact-to-charge means employs the method for correcting the reference potential to be supplied to the contact-to-charge means by measuring the charge potential on the surface of the photosensitive drum so that the charge potential on the surface of the photosensitive drum is kept at the target potential.

What is claimed as new and desired to be secured by letters patent of the United States is:

1. An image forming apparatus comprising:

contact-to-charge means for charging an image carrier by coming in contact with said image carrier;

reference voltage applying means for applying a reference voltage to said contact-to-charge means;

potential detection means for detecting a charge potential of said image carrier;

environmental condition detection means for detecting environmental conditions which have an effect on a charge potential of said contact-to-charge means; and control means for controlling said reference voltage applying means on the basis of a detection result obtained by said potential detection means and a detection result obtained by said environmental condition detection means;

said control means comprising reference voltage correction means for correcting the reference voltage of said reference voltage applying means so that the charge potential of said image carrier is brought to a target potential level, and timing setting means for setting an execution timing of said reference voltage correction means.

2. An image forming apparatus according to claim 1, wherein said environmental condition detection means is a temperature sensor.

3. An image forming apparatus according to claim 1, wherein said environmental condition detection means is a moisture sensor.

4. An image forming apparatus according to claim 1, wherein said environmental condition detection means comprises a temperature sensor and a moisture sensor.

5. An image forming apparatus according to claim 2, wherein said timing setting means establishes an execution timing for said reference voltage correction means on the basis of a detection result obtained by said temperature sensor.

6. An image forming apparatus according to claim 5, wherein said timing setting means shortens time interval for correcting the reference voltage when a detected temperature of said contact-to-charge means detected by said temperature sensor is low whereas said timing setting means lengthens a time interval for correcting the reference voltage when the detected temperature of said contact-to-charge means detected by said temperature sensor is high.

7. An image forming apparatus according to claim 5, wherein said timing setting means is given a corresponding relationship between the temperature of said contact-to-charge means and the number of copy sheets in order to lengthen the execution time interval of said reference voltage correction means as the temperature of said contact-to-charge means rises.

8. An image forming apparatus according to claim 5, wherein said timing setting means executes correction of the reference voltage when a temperature difference between a preceding temperature detected by said temperature sensor and a present temperature detected by said temperature sensor is equal to or more than a comparison reference value.

9. An image forming apparatus according to claim 8, wherein said timing setting means changes the comparison reference value on the basis of the temperature detected by said temperature sensor so that the number of times of execution of said reference voltage correction means is reduced as the temperature of said contact-to-charge means rises.

10. An image forming apparatus according to claim 1, wherein said reference voltage correction means controls the reference voltage of said reference voltage applying means on the basis of the temperature of said contact-to-charge means so that the charge potential of said image carrier may come closer to the target potential level.

* * * * *